US005607375A

United States Patent [19]

Dalebout et al.

[11] Patent Number: 5,607,375

[45] Date of Patent: Mar. 4, 1997

[54] INCLINATION MECHANISM FOR A TREADMILL

[76] Inventors: William T. Dalebout, 1770 E. 1730 North, North Logan, Utah 84321; Greg W. Law, 578 Maple Dr., Smithfield, Utah 84335

[21] Appl. No.: 539,249

[22] Filed: Oct. 5, 1995

Related U.S. Application Data

[63] Continuation-in-part of Ser. No. 363,194, Dec. 24, 1994, abandoned.

[51] Int. Cl.[6] ..... A63B 22/02

[52] U.S. Cl. ..... 482/54; 482/51; 482/52; 482/70; 482/71

[58] Field of Search ..... 482/51, 52, 54, 482/70, 71

[56] References Cited

U.S. PATENT DOCUMENTS

| | | | |
|---|---|---|---|
| D. 270,555 | 9/1983 | Ogden . | |
| D. 283,239 | 4/1986 | Smith et al. . | |
| 284,294 | 9/1883 | Graves . | |
| D. 284,597 | 7/1986 | Smith . | |
| 659,216 | 10/1900 | Dowling et al. . | |
| 1,778,635 | 10/1930 | Heisler . | |
| 2,440,644 | 4/1948 | Powell . | |
| 3,826,491 | 7/1974 | Elder . | |
| 3,858,938 | 1/1975 | Kristensson et al. . | |
| 3,892,404 | 7/1975 | Martucci . | |
| 3,963,101 | 6/1976 | Stadelmann et al. . | |
| 3,966,182 | 6/1976 | Stadelmann et al. . | |
| 4,093,196 | 6/1978 | Bauer . | |
| 4,344,616 | 8/1982 | Ogden . | |
| 4,374,587 | 2/1983 | Ogden . | |
| 4,383,714 | 5/1983 | Ishida . | |
| 4,445,683 | 5/1984 | Ogden . | |
| 4,502,679 | 3/1985 | De Lorenzo . | |
| 4,576,352 | 3/1986 | Ogden . | |
| 4,591,147 | 5/1986 | Smith et al. . | |
| 4,635;927 | 1/1987 | Shu . | |
| 4,635,928 | 1/1987 | Ogden et al. . | |
| 4,643,418 | 2/1987 | Bart . | |
| 4,664,371 | 5/1987 | Viander . | |
| 4,729,558 | 3/1988 | Kuo . | |
| 4,751,755 | 6/1988 | Carey, Jr. et al. . | |
| 4,759,540 | 7/1988 | Yu et al. . | |
| 4,776,582 | 10/1988 | Ramhorst . | |
| 4,792,134 | 12/1988 | Chen . | |
| 4,813,743 | 3/1989 | Mizelle . | |
| 4,844,449 | 7/1989 | Truslaske | 482/54 |
| 4,886,266 | 12/1989 | Trulaske . | |
| 4,913,396 | 4/1990 | Dalebout et al. . | |
| 5,007,630 | 4/1991 | Real et al. . | |
| 5,029,801 | 7/1991 | Dalebout et al. . | |
| 5,058,881 | 10/1991 | Measom | 482/54 |
| 5,352,167 | 10/1994 | Ulicny | 482/54 |

*Primary Examiner*—Lynne A. Reichard
*Attorney, Agent, or Firm*—Trask, Britt & Rossa

[57] ABSTRACT

An exercise apparatus in combination with an incline adjustment mechanism having a support frame, a support rotatably associated with the support frame, a pawl positioned to interact with the support and a spring for urging the pawl into engagement with the support is disclose. The support defines a plurality of notches. The pawl is received into each resistive notch to form a detachable union of the pawl with the support. An engagement of the pawl with each notch orients the support in a predetermined position which corresponds to a respective incline for the exercise apparatus which is connected to the support frame.

18 Claims, 7 Drawing Sheets

INCLINATION MECHANISM FOR A TREADMILL

This application is a CIP of U.S. patent application Ser. No. 08/363,194, filed Dec. 24, 1994, now abandoned.

BACKGROUND OF THE INVENTION

1. Field of the Invention

This invention relates to exercise equipment of the type utilized to improve the user's physical conditioning. More specifically, the invention is directed to an exercise apparatus whose orientation relative to an underlying support surface may be adjusted to either increase or diminish the level of difficulty of exercises performed on the apparatus.

2. State of the Art

The functionality of many types of exercising equipment is enhanced by modifying the orientation of that equipment relative to an underlying support surface. In many instances, this capability to reorient the equipment permits the user to adjust and oftentimes increase the level of difficulty of exercises performed using the equipment. This capability becomes important when one recognizes that training, utilizing such equipment, is directed toward increasing the user's physical abilities. As those abilities are augmented, it is desirable that the user may periodically adjust the level of difficulty of the equipment to provide a device conducive to challenging the user's physical abilities and to contributing to an enhancement of these abilities.

The difficulties in rendering exercise equipment incline adjustable results in part from the weight of such equipment. Due to the stress which such equipment must endure in use, oftentimes such equipment is fabricated from various types of metals, which cause the equipment to be generally heavy. Adjusting the incline of the equipment may be difficult if the user must lift the equipment to the desired height and then manipulate a retaining device which is operable to retain the equipment at the desired height. As a result, some exercise equipment requires two or more individuals to adjust the incline thereof, i.e. one individual holding the equipment in place while the second actuates the retaining device.

A conventional incline system is illustrated in U.S. Pat. No. 4,477,071 (Davis). FIG. *6i* of that disclosure illustrates an adjustable incline system which consists of an inverted "T"-shaped support leg having a plurality of open-ended channels defined in the shaft region thereof. The support leg is received within a socket. The socket sidewall defines a pair of oppositely positioned holes which are positioned to register one with another. A pin is inserted through the socket hole and thereafter through one of the support leg channels. The pin subsequently is received in the opposing socket sidewall hole whereby the support leg is detachably retained in the apparatus mounted socket. The incline of the apparatus may be altered by slidingly removing the pin and adjusting the support leg to align another channel in registration with the socket holes. Thereafter, the pin is reinserted to retain the support leg in the desired orientation. Recognizably, the apparatus must be lifted in order to facilitate any adjustment to its incline.

A second embodiment of an incline system is depicted in U.S. Pat. No. 4,374,587 (Ogden) wherein a pair of upright threaded support legs are mounted spacedly apart from one another on the end of a treadmill. The bottom end of each support is rotatably mounted by a ball joint to a footing which rests on the underlying support surface, e.g. the ground. A female threaded socket is mounted on each support, each socket being fixedly mounted to the apparatus to be inclined. One of the supports includes a hand crank mounted thereon. The crankable support is mechanically connected to the non-cranked support by a chain which is trained about sprockets mounted on each of the two supports. A cranked rotation of the first support effects a corresponding rotation of the second support. The sockets are displaced upwards or downwards, depending on the direction of rotation of the supports. The apparatus, being mounted to the sockets, is displaced by the sockets.

The Ogden construction involves a considerable amount of structure to effect the lifting or incline function.

A continued need exists for an inclined system which is simple in construction yet operative to yield a desired equipment incline with a minimum of energy.

SUMMARY OF THE INVENTION

The instant invention includes an exercise apparatus in combination with an incline adjustment mechanism adapted for adjusting the incline of the exercise apparatus relative to an underlying support surface. The incline adjustment mechanism is provided to permit the user to alter the difficulty of exercises performed on the exercise apparatus by adjusting the incline of the apparatus relative to an underlying support surface. It should be understood that the invention is not limited to any particular type of exercise apparatus. While the invention may be illustrated by reference to a treadmill, it is important to understand that any exercise apparatus may be utilized in the invention.

The invention may include an exercise apparatus in combination with a support structure which may include a support frame; at least one support, which is rotatably connected to the support frame; at least one pawl, which is configured to form a detachable union with the support to retain the support in a fixed orientation relative to the support frame; and at least one spring for urging the pawl into engagement with the support.

The support frame is connected to the exercise apparatus whose inclination, relative to an underlying surface, is to be adjusted. The support frame may be formed by two subframes which are connected to the exercise apparatus at suitable locations thereon, for example on opposing sides of the exercise apparatus proximate an end of that apparatus.

The support is rotatably connected to the support frame. In one embodiment, the support may include two support members, each support member being individually mechanically associated with a respective support subframe to be rotatable about that subframe. The support members may be associated with the subframe by respective pivot axles which are individually secured to a respective subframe and which provide a pivot axis for their respective support members. One end of each support member is configured to engage the underlying support surface. The portion of the support which extends from the pivot axle to this particular end which engages the underlying surface may have greater mass associated therewith than the portion of the support which extends from the pivot axis to the opposing end of the support. Due to one portion of the support being heavier than the other, the support tends to rotate about its pivot axis when the support is supported solely by its pivot axis. This occurs when the exercise apparatus is lifted above the underlying support surface sufficiently that the support no longer is supported by the underlying surface. Each support member includes a ratchet section which is configured to define one or more recesses or notches.

The pawl of the invention may be mechanically associated with the support frame to be rotatable about that support frame. In one construction, the pawl is associated with the support frame by means of a pivot axle secured to the support frame. The pawl is mounted on the axle to rotate about a pivot axis defined by the pivot axle. Alternatively, the pawl may be secured to other structure such as the exercise apparatus itself.

The pawl is positioned to be proximate the support. In those constructions wherein the support is formed by two or more support members, the pawl may be formed of a number of pawl members, one pawl member being associated with each particular support member. The pawl includes a finger or extension structure which is configured to be received in one or more of the recesses or notches defined in the support. Upon the finger being received in the notch, the pawl forms a detachable union with the support which effectively fixes the orientation of the support relative to the support frame and hence to the exercise apparatus. By fixing the support relative to the exercise apparatus, and owing to the engagement of one end of the support with the underlying support surface, the inclination of the exercise apparatus is thereby also fixed. By disengaging the pawl from the support and thereby permitting the support to rotate about its pivot axis, the user may adjust the incline of the exercise apparatus. In those instances wherein multiple notches are provided in the support, the user may adjust the inclination of the exercise apparatus to one of a multiple number of inclination settings by engaging the pawl with a selected notch in the support.

A spring is associated with the pawl to provide a moment or torque on the pawl. In those instances wherein the pawl is formed by a number of individual pawl members, a respective spring may be associated with each pawl member. In one construction, the spring is connected on its first end to the pawl. The second end of the spring is connected to structure spatially removed from the pawl, such as the support frame. The orientation of the spring is arranged to apply a force on the pawl suitable for creating a moment or torque on the pawl about its pivot axis. The pawl is thereby biased against its respective support causing the finger of the pawl to be urged against the ratchet section of the support which defines the notch or notches. As the user causes the support to rotate about its axis of rotation, for example by lifting the exercise apparatus and permitting gravity to cause a rotation of the support about its pivot axis, the pawl is positioned to insert its finger into the notch upon that notch being brought into positioning for such an engagement.

DETAILED DESCRIPTION OF THE ILLUSTRATED EMBODIMENT

Figure 1:
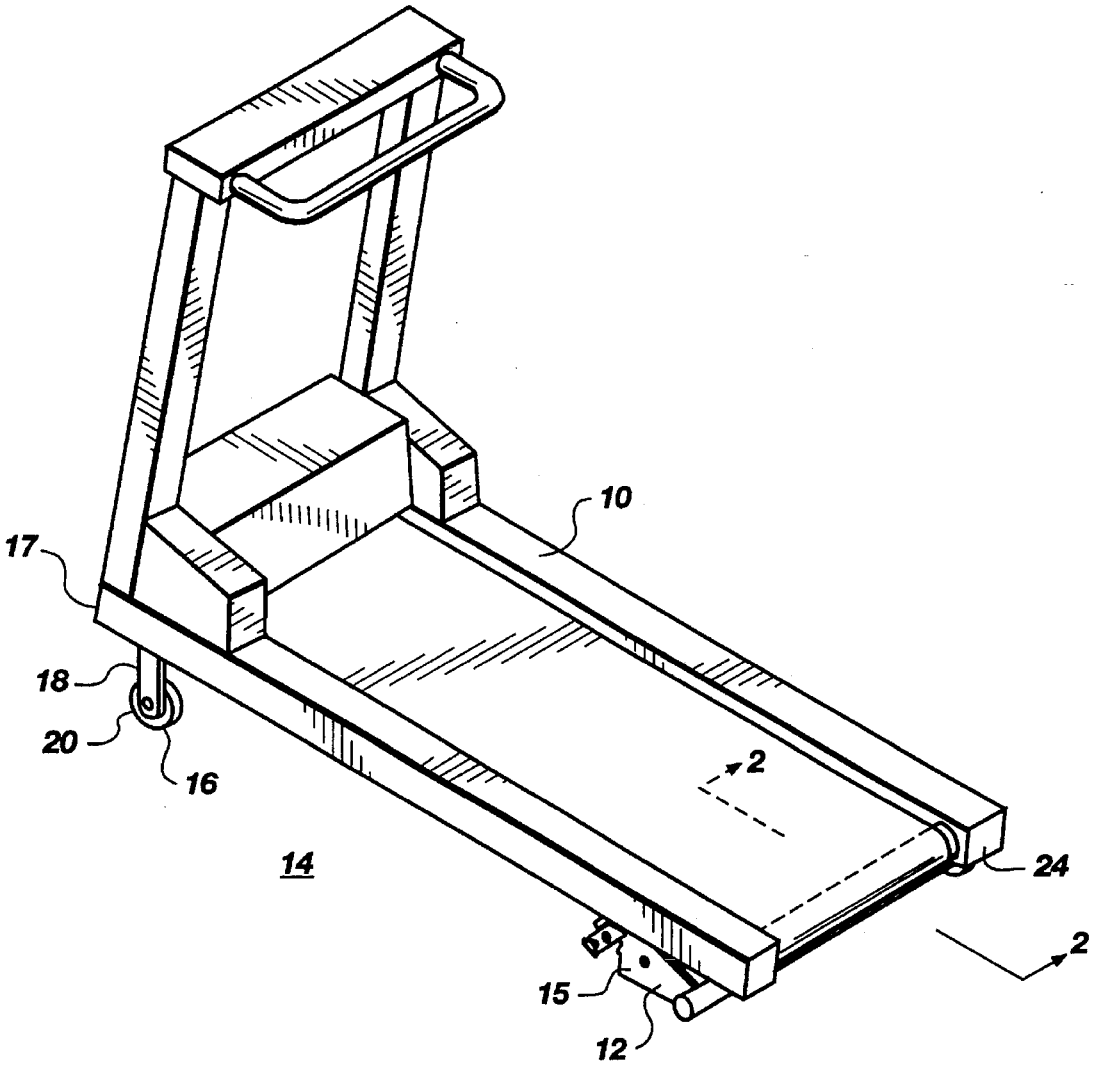
FIG. 1 is an elevated perspective view of an exercise apparatus in combination with an incline adjustment mechanism according to the instant invention, the frame support of said mechanism having been removed for clarity.

FIG. 1 illustrates an exercise apparatus 10 having an incline adjustment mechanism 12 associated therewith. As shown, exercise apparatus 10 is a conventional treadmill. It should be understood that a treadmill is shown merely for illustrative purposes. Any type of exercise apparatus suitable for use with the incline adjustment mechanism may be used in the invention.

As shown, the treadmill is supported above an underlying surface 14 by a first support 16. Another support 16 is positioned on the opposing side of the treadmill from the illustrated support 16, though this support 16 is not shown. Each of the supports 16 includes a vertically disposed extension 18 which is connected to the treadmill frame on its first end 17. Each support 16 has a wheel 20 mounted on its free end. The supports 16 function to elevate the first end 17 of the treadmill 10 above the underlying surface 14.

The incline adjustment mechanism 12 is shown mounted to the treadmill proximate its second or trailing end 24. In the illustrated embodiment, two support structures are utilized. These support structures are interconnected to jointly provide an incline adjustment function. While the illustrated embodiment is described as including two support structures, it should be recognized that a single support structure of the type to be described may also be used with other types of exercise apparatus. FIG. 1 illustrates one of two support structures 15 which together constitute the mechanism 12. A support structure 15 which is essentially the mirror image of that shown is mechanically associated with the treadmill on the opposing side of the treadmill. The instant description will be directed to one of the two support structures, it being recognized that the second support structure is essentially identical to the first support structure 15.

Figure 2:
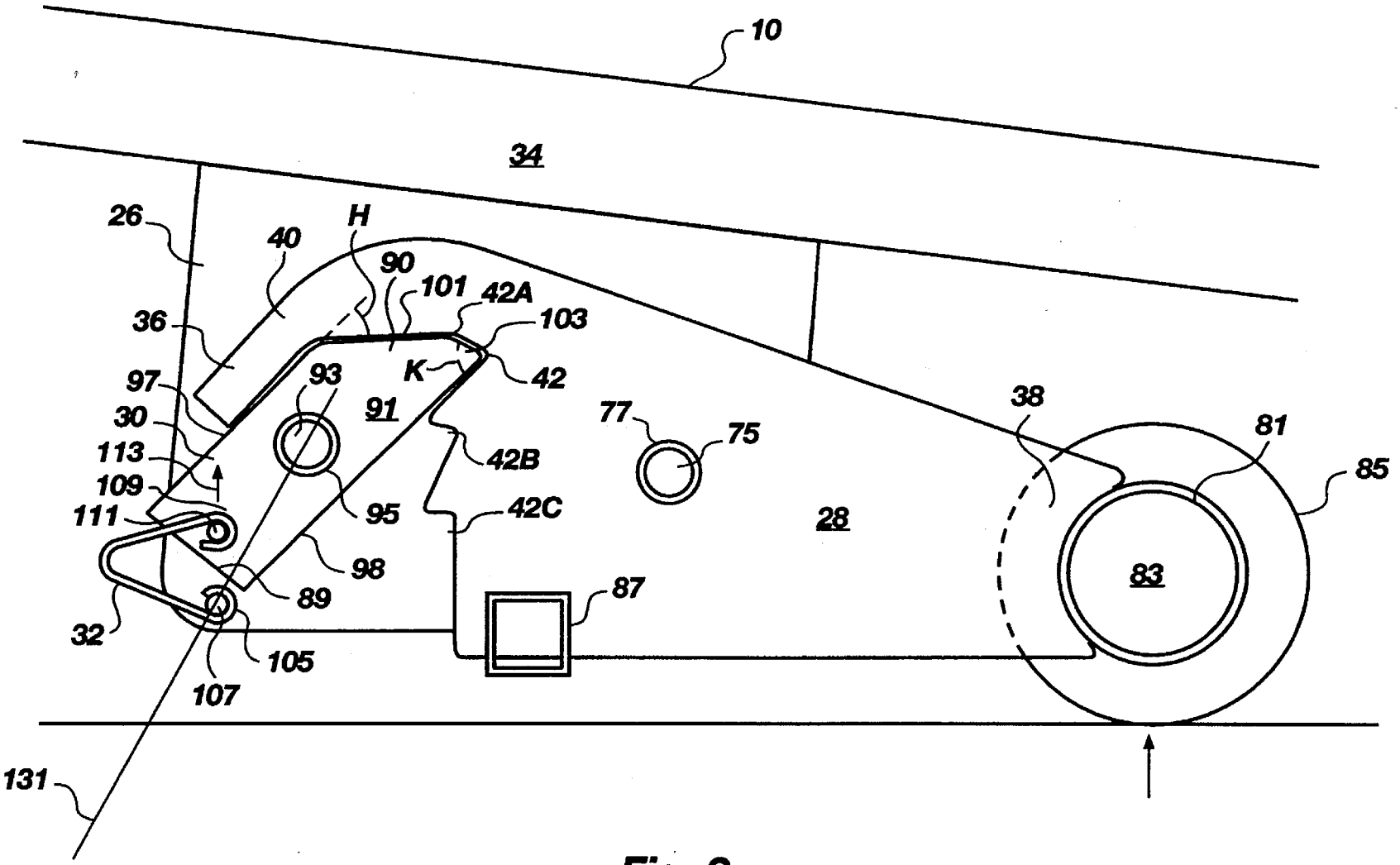
FIG. 2 is a sectional side view of an incline adjustment mechanism of FIG. 1 taken along section line 2—2, the mechanism being shown positioned in a first condition.

The first support structure, as shown to advantage in FIG. 2, includes a support sub-frame 26, a support 28, a pawl 30 and a spring 32. The subframe 26 is shown as being a generally rectangular planar member which is secured to the frame 34 of the treadmill 10 along one side of that planar member. The planar member is disposed in a generally upright vertical orientation. The planar member may be fabricated of metal and secured to the metal frame of the treadmill by welding.

Figure 6:
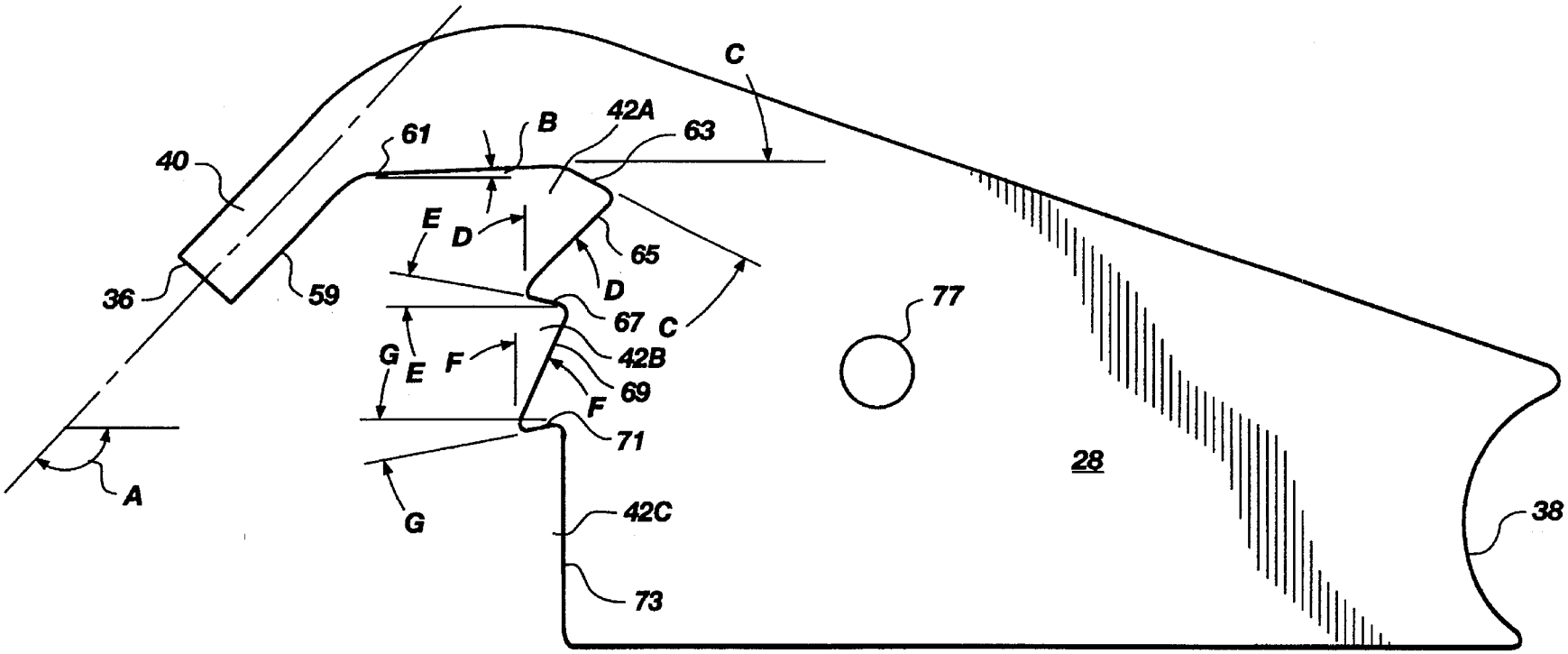
FIG. 6 is a side elevational view of a support of the incline adjustment mechanism.

The support 28 is an elongate planar panel having a first end 36 and a second end 38. The first end 36 defines an elongate finger-like extension 40 which forms a stop for the pawl 30. The support 28 further defines a ratchet section having a plurality of recesses or notches 42 along its perimeter. In the support illustrated in FIG. 6, three distinct notches are defined in the perimeter of the support 28. The first notch 42A is defined by one side of the extension 40 in association with a recess formed by the sides 61, 63, and 65 of the support. As shown in FIG. 2, that portion of the perimeter of the support which defines the first notch substantially corresponds to the perimeter of a section of the pawl 30 whereby the pawl may be surrounded on a plurality of its sides when that pawl is inserted into the first notch 42A.

The second notch 42B is defined by the sides 67 and 69 of the perimeter of the support 28. The third notch 42C is defined by the sides 71 and 73 of the support 28. As noted in FIG. 6, the support 28 may include a specific geometry to accomplish the purposes of the notches 42A, 42B and 42C. As shown, the extension 40 may be viewed as being substantially a rectangularly configured section having a longitudinal axis which is oriented to a horizontal axis at an angle A. Given the essentially rectangular configuration of extension 40, it should be understood that linear side 59 would also be oriented at an angle A to the horizontal. In a preferred construction, angle A may be within the range of 125 to 136 degrees and preferably 131 degrees. The side 61 which extends from side 59 is oriented at an angle B from the horizontal. In preferred constructions, angle B may be within the range of zero to ten degrees, preferably 4 degrees. Side 63, which extends from side 61, is oriented at an angle C from the horizontal. Angle C is within the range of 22 to 34 degrees and preferably approximately 28 degrees. Side 65 which extends from side 63 is oriented at an angle D from the vertical. In preferred constructions, angle D may be within the range of 36 to 48 degrees and preferably 43 degrees. Side 67 which extends from side 65 is oriented at an angle E from the horizontal. In a preferred construction, angle E is within the range of four to fifteen degrees and preferably 9 degrees. Side 69, extending from side 67, defines an angle F from the vertical. Angle F is preferably within the range of 17 to 29 degrees and preferably 23 degrees. Side 71, which extends from side 69, is oriented at an angle G from the horizontal. Angle G is within the range of five to fifteen degrees and preferably 10 degrees. Side 73, which extends from side 71, is oriented vertically upright, i.e. at an angle of 90 degrees to the horizontal. Sides 67, 69, 71 and 73 are dimensioned to provide sufficiently deep notches to enable the tip of the pawl 30 to be received in the notches and form a detachable union with each notch to retain the support in a fixed orientation relative to the exercise apparatus.

The support 28 is rotatably connected to the subframe by means of a pivot axle 75. As shown, this axle 75 is an elongate cylindrical member which extends outwardly and perpendicularly from the surface of the subframe 26. The axle 75 extends through a circular aperture 77 defined within the support 28. Various approaches may be adopted to enable the support to rotate about the subframe 26. The axle may be fixedly secured to the subframe, while the support 28 is made rotatable about the axle 75. Alternatively, the axle may be fixedly secured to the support 28 and rotatably secured to the subframe. Furthermore, the axle may be rotatably secured to the subframe while the support 28 is rotatably secured to the axle.

Figure 5:
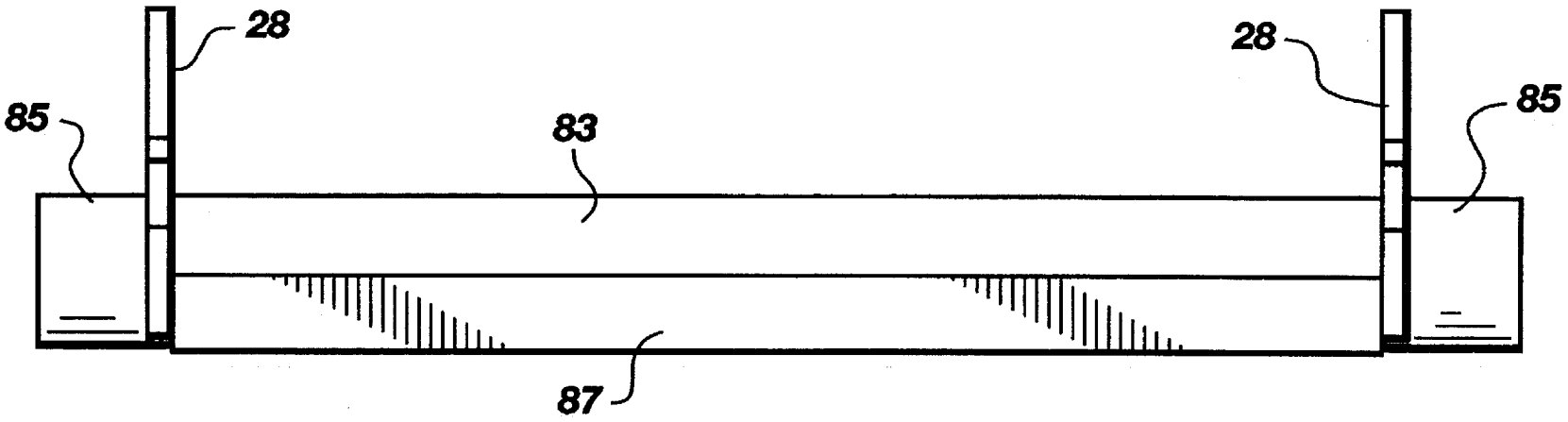
FIG. 5 is a front section view of a pair of supports of the invention interconnected by a connection shaft, the pawl and spring having been removed for clarity.

The end 38 of the support 28 may be adapted for securement to a connection bar 81 which extends between two spacedly positioned supports 28. As shown in FIG. 5, a connection bar 81 is secured to each of the ends 38 of the pair of supports 28. In the illustrated configuration, the opposing ends 83 of the bar 81 are fitted with end caps 85. The end caps 85 are preferably fabricated from a material having a high coefficient of friction. The end caps 85 rest directly on the underlying surface and form the point of contact between the incline adjustment mechanism and the underlying surface. The use of a material having a high coefficient of friction facilitates the use of a wheel on the front supports 16 of the exercise apparatus.

The supports 28 may be further interconnected to one another by means of a spacer bar 87. This bar 87 may be fixedly secured to each of the supports 28 at a location proximate side 73. The bar 87 extends between the two supports 28 and forms a means of stabilizing the supports during their operation.

The pawl 30, as shown in FIG. 2, is a planar member having a somewhat rectangular configuration on one end 89 thereof and a specially configured lip 90 on its opposing end 91. The pawl 30 is rotatably secured to the subframe 26 by a pivot axle 93. Axle 93 may be configured as an elongate cylindrical shaft which is secured on its first end to the subframe 26. The pawl 30 is mechanically secured to the subframe 26 by the pivot axle 93 so as to be rotatable with respect to that subframe 26. In one embodiment, the axle 93 may extend through a circular aperture 95 defined in the pawl 30, with the pawl being rotatable with respect to the axle 93. In this embodiment, the opposing end of the axle may be fixedly secured to the subframe. Alternatively, the axle could be rotatably secured to the subframe. As to the specifics of the mounting of the pawl 30 to the axle 93 and the subsequent mounting of the axle 93 to the subframe 26, the previously described approaches discussed above with reference to the attachment of the support 28 to the subframe 26 may also be applied.

The lip 90 of the pawl 30 is configured to be received within the first notch 42A defined in the support 28. As shown in FIG. 2, the pawl includes two generally parallel linear sides 97, 98 and a linear end 89 which is oriented generally perpendicular to each of the sides 97. The pawl further includes a linear side 101 which extends from side 97 generally at an angle H. Angle H is within the range of approximately 35 to 55 degrees. Another side 103 extends from side 98 at an angle K. Angle K is approximately 65 to 80 degrees. Side 103 interconnects with side 101.

A substantially "V"-shaped spring 32 is secured at its first end 105 to the subframe 26 by means of a pin 107 which is affixed to the subframe to extend perpendicularly outward from the subframe. The end 105 is formed into a substantially circular configuration which in turn is wrapped around the pin 107 to form a connection of the spring and the pin 107. The opposing end 109 of the spring 32 is also formed into a generally circular configuration; this in turn is secured about a pin 111 which is affixed to the pawl 30. The spring 32 is constructed to exert a force in the direction of arrow 113 as indicated in FIG. 2. The spring therefore urges the pawl 30 and, more specifically, the lip 90 of that pawl into abutment against the support 28 proximate the notches of that support. As shown in FIG. 2, the pawl is urged to rotate in a clockwise direction by the spring 32. As the support 28 is rotated in a clockwise direction, for example by the operation of gravity as the trailing end of the treadmill is lifted sufficiently above the underlying surface, the pawl 30 is urged against the perimeter of the support which defines the notches. As the lip 90 of the pawl is urged into one of the notches, the pawl forms a detachable connection with the support 28.

Figure 3:
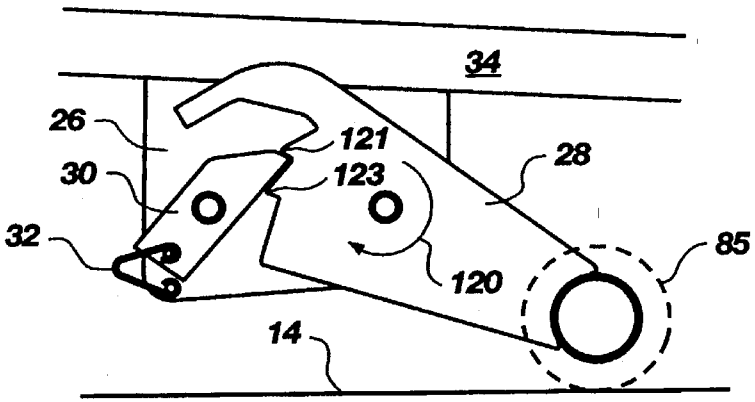
FIG. 3 is a side view of the incline adjustment mechanism of FIG. 2 wherein the spacer bar has been removed for clarity and the support of the mechanism has repositioned to a second condition.

When the support 28 engages an underlying surface, such as a floor, the underlying surface applies a normal force to the support, thereby urging the support to rotate in a counterclockwise direction about its pivot axis as shown in FIG. 2. Should the pawl 30 be secured in notch 42A of the support 28 as shown in FIG. 2, the counterclockwise rotation of support 28 about its pivot axis is precluded due to the pawl's effectively locking the support in position. When the trailing edge of the exercise apparatus is lifted vertically upwards sufficiently that the support 28 is no longer supported by the underlying support surface, the weight of the end 38 of the support 28 urges the support 28 to rotate clockwise about its pivot axis as shown in FIG. 3 by arrow 120. The spring 32 is configured such that it does not apply a sufficient force to the pawl 30 to preclude the clockwise rotation of the support 28. It follows that the pawl is then rotated counterclockwise a fraction of a revolution due to its contact with the somewhat irregular configuration of the perimeter edge of the support 28. As the support 28 continues to rotate, the lip 90 of the pawl 30 eventually passes over the angled point 121 on the perimeter of the support 28. After clearing the point 121, the spring 32 urges the pawl 30 to rotate in a clockwise direction, thereby urging the pawl 30 into engagement with notch 42B positioned elevationally below the point 121. With the pawl 30 engaged in notch 42B, the exercise apparatus is retained in a second orientation or condition as illustrated in FIG. 3.

Figure 4:
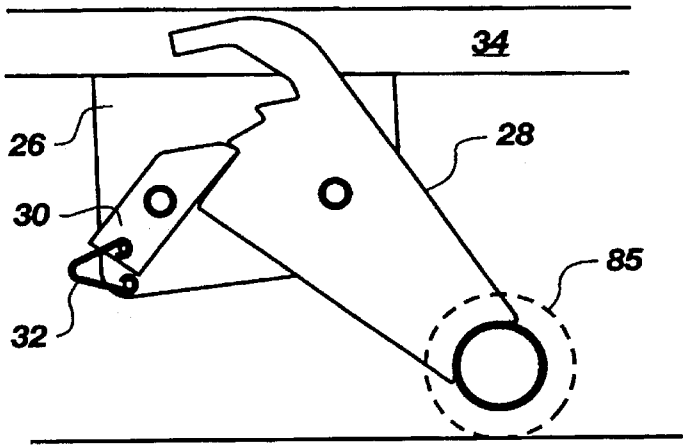
FIG. 4 is a side view of the incline adjustment mechanism of FIG. 2 wherein the spacer bar has been removed and the support of the mechanism has been repositioned to a third condition.

If the exercise apparatus is lifted further, the support 28 is again rotated clockwise even further, resulting in the pawl 30 again being rotated counterclockwise by the contact of the pawl with the irregularly configured perimeter of the support 28. Should the pawl tip 90 pass over the point 123, then the pawl is urged in a clockwise direction by the action of spring 32 into engagement with the notch 42C positioned elevationally below angled point 123. With the pawl engaged in notch 42C, as illustrated in FIG. 4, the exercise apparatus 10 is then retained in a third orientation or condition.

Figure 7:
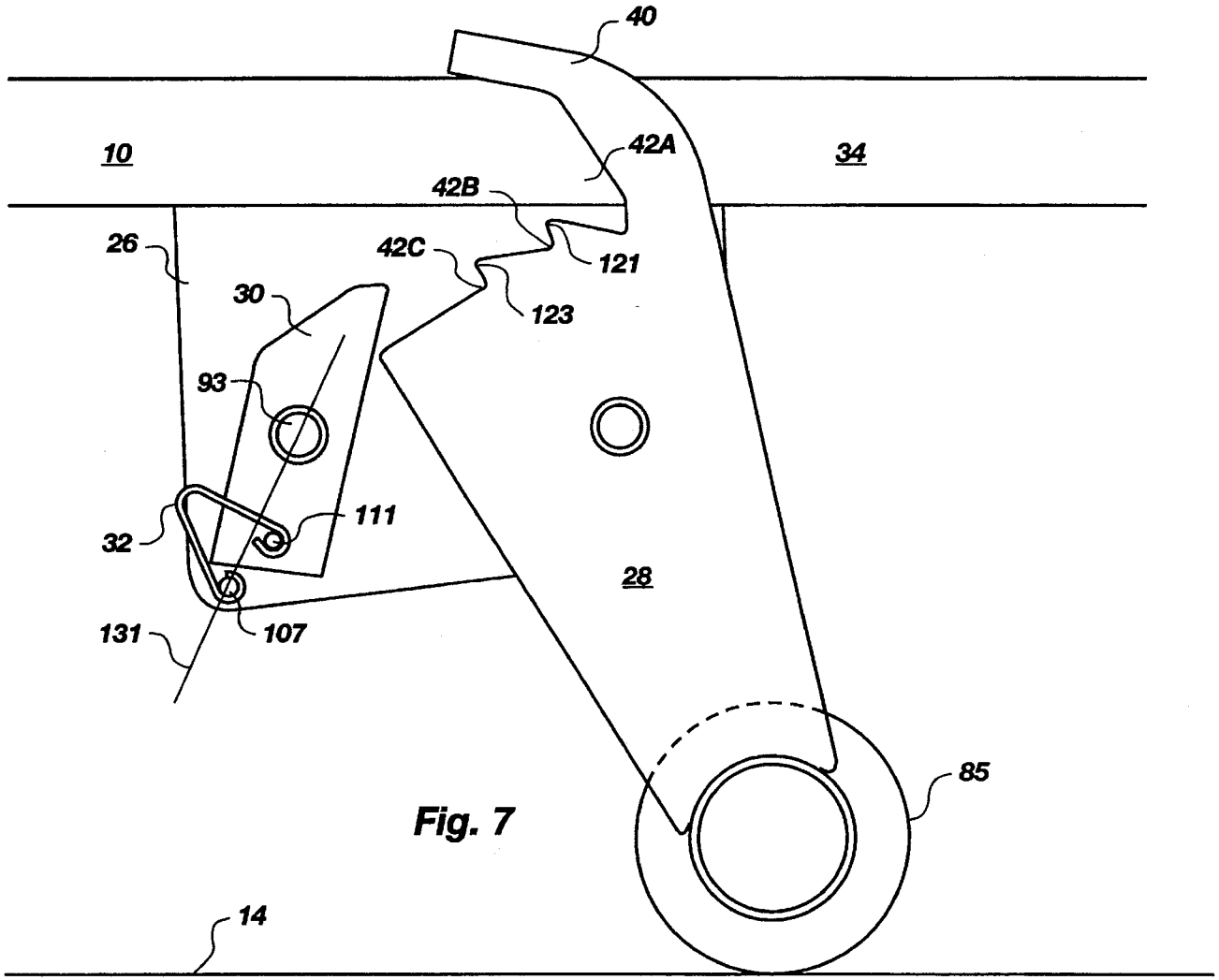
FIG. 7 is a side view of the incline adjustment mechanism of FIG. 2 with the support of the mechanism being repositioned in a fourth condition, the spacer bar having been removed for clarity purposes.

When the pawl 30 is engaged in notch 42C, the support 28 may be returned to the position illustrated in FIG. 2 by lifting the trailing edge of the exercise apparatus 10 sufficiently to cause a gravity induced rotation of the support 28 clockwise about its pivot axis. The continued rotation of the support 28 causes the pawl 30 to be rotated counterclockwise sufficiently that the point of connection of the spring 32 to the pawl, i.e. the pivot axle 111, physically passes over the line 131 which passes through the pivot axle 107 and the pivot axle 93. Once the pivot axle 111 passes over line 131, the forces acting on the pawl are directioned such that the pawl 30 is retained positioned substantially as shown in FIG. 7, i.e. the pawl becomes stationary. With the pawl positioned as shown in FIG. 7, the user may rotate the support 28 in a counterclockwise direction without having the pawl being urged against the support 28. As the support 28 is rotated counterclockwise, eventually the extension 40 contacts the pawl 30. As the support 28 is then further rotated counterclockwise, the support 28 applies a force to the pawl to urge the pawl to rotate in a clockwise direction. As the pawl is rotated in a clockwise direction, eventually the pivot axle 111 passes back over the line 131, whereafter the force applied to the pawl by the spring 32 urges the pawl to rotate in a clockwise direction as described above. The support 26 and the pawl 30 are eventually rotated to the orientation shown in FIG. 2. The incline adjustment mechanism is then in the first condition as depicted in FIG. 2.

The extension 40 in conjunction with the shape of the support perimeter which defines the first notch is specially configured to force the end of the pawl 30 into the orientation shown in FIG. 2 upon the support being brought into contact with the pawl. In those constructions wherein the incline adjustment mechanism is mounted on the rear or trailing end of the exercise apparatus and the apparatus is elevated proximate its leading end by a support structure such as the structure in FIG. 1, the placement of the pawl in the first notch orients the apparatus in its steepest inclination. As the pawl is moved from the first notch to the succeeding notches, the inclination of the apparatus is decreased.

In a preferred construction, a subframe 26 is mounted to each side of the exercise apparatus 10. The subframes are typically mounted on opposing sides of the apparatus and may be mounted an equal distance from an end of the apparatus. This mounting orientation promotes stability for the incline mechanism and exercise apparatus combination. In a preferred construction, the exercise mechanism is mounted proximate the trailing end of the exercise apparatus 10. It should be understood that alternative mounting arrangements are also possible. For example, the incline adjustment mechanism could be mounted proximate the leading end of the exercise apparatus.

Figure 9:
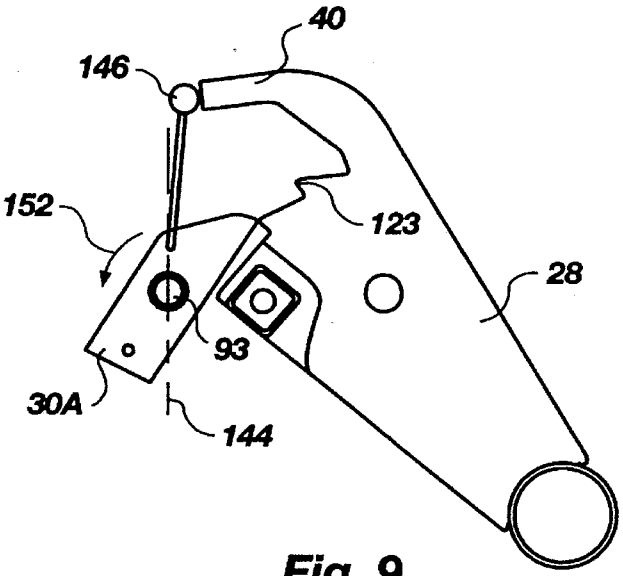
FIG. 9 is a side view of the embodiment of FIG. 8 wherein the mechanism is shown in a second condition.
Figure 10:
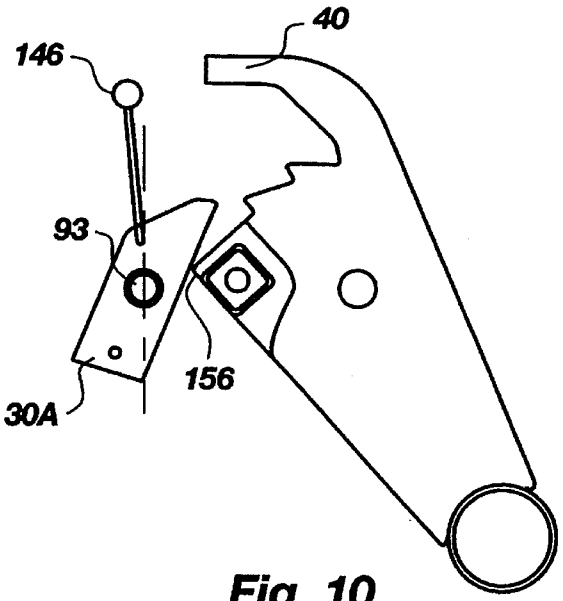
FIG. 10 is a side view of the embodiment of FIG. 8 wherein the mechanism is shown in a third condition.
Figure 8:
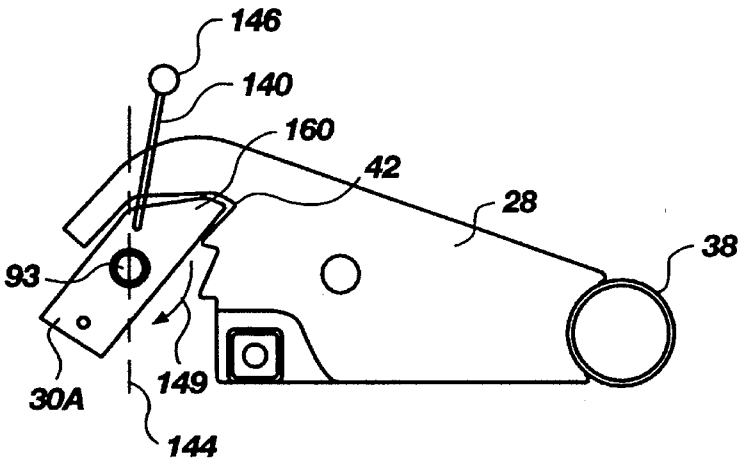
FIG. 8 is a side view of an alternative embodiment of the incline adjustment mechanism of the invention, the mechanism being illustrated in a first condition.

FIGS. 8–10 illustrate an alternative embodiment of the instant invention. In this particular construction, the function of the spring 32 is assumed by a weighted structure 140 which is secured to the pawl **30*a* as indicated. Structure 140 includes a weight 146 and an extension arm which is secured on one end to the pawl 30A and on its opposing end to the weight 146. In the condition illustrated in FIG. 8, the weight structure 140 is positioned to be on the fight side of the vertical axis 144 which passes through the center of the pivot axle 93. In this particular orientation, the positioning of the weighted end of the structure 140 creates a moment on the pawl 30A about the pivot axis 93 which tends to urge the pawl to rotate in a clockwise direction as indicated by arrow 149. As noted in FIG. 8, the end 160 of the pawl 30A is received in the notch 42 formed in the structure of support 28, thereby locking the support 28 in position. As the trailing edge of the exercise apparatus 10 is lifted vertically upwards sufficiently that the underlying surface no longer supports the support 28, the weight of the end 38 of the support 28 urges the support 28 to rotate clockwise about its pivot axis as shown by FIG. 9. As the support 28 rotates clockwise about its pivot axis, the weighted end of the pawl 30A urges the pawl 30A to rotate in a clockwise direction thereby retaining the end 160 of the pawl 30A in engagement against the support 28. As the end 160 passes over each of the points of the support, the pawl 30A is positioned within an adjacent notch, thereby displaceably locking the pawl 30A and support 28 together. Should the support be urged to rotate further in a clockwise direction, the point 123 engages the pawl 30A and urges the pawl 30A to rotate in a counterclockwise direction as shown by arrow 152. As the counterclockwise rotation of the pawl 30A continues, the weighted end 146 approaches the vertical axis 144. As the weighted end 146 approaches the axis 144, the magnitude of the moment applied to the pawl 30A is decreased. With the continued clockwise rotation of the support 28, eventually the point 156 of the support 28 contacts the pawl 30A and forces the pawl 30A to rotate sufficiently counterclockwise that the weighted end 146 passes through the vertical axis 144, thereby positioning the weighted end 146 on the left side of the vertical axis 144. In the orientation illustrated in FIG. 10, the weighted end 146 applies a small moment to the pawl 30A to urge that pawl to rotate in a counterclockwise direction. It is preferred that the size of the mass utilized for the weighted end 146 be selected such that the magnitude of this latter moment is insufficient alone to overcome the inertia of the pawl 30A and cause the pawl 30A to rotate counterclockwise. In the condition shown in FIG. 10, the pawl 30A is configured such that the forces acting on the pawl due to the mass of the pawl and the allocation of that mass are such that the pawl is essentially retained in the illustrated position. The support 28 is then manually rotated in a counterclockwise direction, thereby bringing the extension 40 of the support into contact with the end 160 of the pawl 30A. This applies a force to the pawl 30A such as to urge the pawl 30A to rotate in a clockwise direction, eventually resulting in the pawl being returned to the orientation illustrated in FIG. 8. In large part, this alternative embodiment operates like the embodiment of FIG. 2 with the exception that the weighted end 146 functionally replaces the action of the spring 32. The weighted structure 146 is positioned such that it does not obstruct the displacement of the support 28 and more specifically the extension 40**.

It should be recognized that the instantly described embodiments are intended solely as a description of preferred embodiments. Those skilled in the art will recognize that the embodiments herein discussed are illustrative of the general principals of the invention. The embodiments herein described are not intended to limit the scope of the claims which themselves recite what applicants regard as their invention.

What is claimed is:

1. An exercise apparatus in combination with an incline adjustment mechanism, said combination comprising:

an exercise apparatus;

a support frame mechanically associated with said exercise apparatus;

an elongate support, said elongate support being rotatably mounted to said support frame, said elongate support defining at least one notch therein;

a pawl rotatably mounted to said support frame about a first pivot axis, said pawl being associated with said elongate support, said pawl being configured to intercooperate with one or more of said notches of said elongate support to form a detachable union of said pawl with said elongate support to retain said elongate support in a fixed orientation; and a structure mechanically associated with said pawl to bias said pawl against said support.

2. The exercise apparatus in combination with an incline adjustment mechanism according to claim 1 wherein said structure is a spring adapted to urge said pawl to rotate about its said first pivot axis.

3. The exercise apparatus in combination with an incline adjustment mechanism according to claim 1 wherein said structure is a weighted structure having a weight secured to an extension extending outwardly from said pawl.

4. An exercise apparatus in combination with an incline adjustment mechanism, said combination comprising:

an exercise apparatus;

a support frame mechanically associated with said exercise apparatus;

two elongate supports, each said elongate support being rotatably mounted to said support frame, each said elongate support defining at least one notch therein;

two pawls, each said pawl being rotatably mounted to said support frame about a first pivot axis, each said pawl being associated with a respective said elongate support, each said pawl being configured to intercooperate with one or more of said notches of said respective elongate support to form a detachable union of said pawl with said respective elongate support to retain said elongate support in a fixed orientation; and two springs, each said spring being mechanically associated with a respective said pawl to urge said pawl to rotate about its said first pivot axis.

5. The combination of claim 4 wherein said elongate supports are interconnected to one another by a shaft which extends therebetween.

6. The combination of claim 4 wherein said shaft is cylindrical in configuration.

7. The combination of claim 4 wherein said elongate support is rotatably connected to said support about a second pivot axis.

8. The combination of claim 4 wherein said first pivot axis is oriented parallel to said second pivot axis.

9. The combination of claim 4 wherein said frame support comprises two subframes.

10. The combination of claim 4 wherein said subframes are connected to said exercise apparatus on opposing sides of said exercise apparatus.

11. The combination of claim 4 wherein each said elongate support is a flat planar member.

12. The combination of claim 4 wherein each said elongate support and its respective pawl are rotatable in a common plane.

13. The combination of claim 12 wherein said common plane is vertically disposed.

14. An exercise apparatus in combination with an incline adjustment mechanism, said combination comprising:

an exercise apparatus;

a support frame having two subframes, said subframes being positioned proximate opposing sides of said exercise apparatus;

two elongate planar supports, each said elongate planar support being rotatably secured to a respective first pivot axle, each said first pivot axle being connected to a respective said subframe; each said elongate planar support defining at least one notch therein;

a connection bar connected to one of said elongate planar supports at each of its ends to extend between said elongate planar supports;

two pawl members, each said pawl member being pivotedly mounted to a respective said subframe by means of a second pivot axle connected to said subframe; a portion of said pawl member being detachably received within said notch of a respective elongate planar support to form a detachable union with said elongate planar support, thereby retaining said elongate planar support in a fixed orientation relative to said exercise apparatus; and two springs, each said spring being connected to a respective said subframe and a respective said pawl member to urge said pawl member to rotate about said second pivot axle and into engagement with said notch.

15. The combination according to claim 14 wherein said elongate planar supports and said pawl members rotate in vertically disposed planes.

16. The combination according to claim 14 wherein each said pawl member and its said respective elongate planar support rotate in common planes.

17. The combination according to claim 14 wherein said exercise apparatus is a treadmill.

18. The combination according to claim 14 wherein said subframes are mounted to opposing sides of said exercise apparatus proximate an end of said exercise apparatus.

* * * * *

UNITED STATES PATENT AND TRADEMARK OFFICE

CERTIFICATE OF CORRECTION

PATENT NO. : 5,607,375
DATED : March 4, 1997
INVENTOR(S) : William T. Dalebout and Greg W. Law It is certified that error appears in the above-identified patent and that said Letters Patent is hereby corrected as shown below:

Title page,
Item [57], ABSTRACT,
Line 5, change "disclose" to -- disclosed --

Column 3,
Line 41, after "support" insert -- , --
Line 62, after "has" insert -- been --

Column 7,
Line 59, change "26" to -- 28 --

Column 8,
Line 27, change "fight" to -- right --

Signed and Sealed this

Eleventh Day of March, 2003

JAMES E. ROGAN
*Director of the United States Patent and Trademark Office*